US005199407A

United States Patent [19]

Sawazaki et al.

[11] Patent Number: 5,199,407

[45] Date of Patent: Apr. 6, 1993

[54] CURRENT LIMITER IN AN IGNITION APPARATUS FOR AN INTERNAL COMBUSTION ENGINE

[75] Inventors: Nobuyuki Sawazaki; Masaaki Taruya; Mitsuru Koiwa, all of Himeji, Japan

[73] Assignee: Mitsubishi Denki Kabushiki Kaisha, Tokyo, Japan

[21] Appl. No.: 769,320

[22] Filed: Oct. 1, 1991

[30] Foreign Application Priority Data

Oct. 4, 1990 [JP] Japan ..... 2-265124
Oct. 4, 1990 [JP] Japan ..... 2-265125

[51] Int. Cl.[5] ..... F02P 3/05

[52] U.S. Cl. ..... 123/644; 315/209 T; 315/224

[58] Field of Search ..... 123/644; 315/209 T, 315/224

[56] References Cited

U.S. PATENT DOCUMENTS 3,838,672 10/1974 Richards et al. ..... 123/644
3,882,840 5/1975 Adamian et al. ..... 123/644
4,899,715 2/1990 Koiwa et al. ..... 123/644

*Primary Examiner*—Andrew M. Dolinar
*Attorney, Agent, or Firm*—Sughrue, Mion, Zinn, Macpeak and Seas

[57] ABSTRACT

A current limiter in an ignition apparatus for an internal combustion engine including a differential amplifier 20 is able to limit a primary winding current of an ignition coil to a prescribed limit value which is independent of a voltage as sensed by a current sensing resistor 11, thus providing a highly stable operating characteristic. The factor of current amplification of the differential amplifier can be increased without accompanying oscillations of the current limiter. The current sensing resistor senses a voltage corresponding to a current flowing from the primary winding of the ignition coil to a power transistor 4 which turns on and off the power supply to the ignition coil. A reference voltage source 12 generates a reference voltage for comparison with the voltage sensed by the current sensing resistor. A differential amplifier absorbs a part of a base current supplied from a storage battery to a base of the power transistor on the basis of a difference between the reference voltage and the voltage sensed by the current sensing resistor. A plurality of output transistors 25, 102 are coupled to form a Darlington circuit which is connected between the differential amplifier and the base of the power transistor. Another reference voltage source 12'' may be provided for generating a second reference voltage, the second reference voltage source being connected between the current sensing resistor and the second input terminal of the differential amplifier for supplying thereto a total sum of the voltage sensed by the current sensing resistor and the second reference voltage.

6 Claims, 2 Drawing Sheets

CURRENT LIMITER IN AN IGNITION APPARATUS FOR AN INTERNAL COMBUSTION ENGINE

BACKGROUND OF THE INVENTION

The present invention relates to a current limiter in an ignition apparatus for an internal combustion engine which serves to limit a primary current flowing in a primary winding of an ignition coil, thereby limiting a secondary current flowing in a secondary winding thereof. More particularly, it relates to such a current limiter which is able to improve stability in the operation of an ignition apparatus.

In general, internal combustion engines such as automotive gasoline engines have a plurality of cylinders for which the order of fuel injection, the order of ignition and the like are controlled in an optimal manner by means of a computerized electronic control unit or "ECU".

The ignition timing of the cylinders of such an engine is determined by cutting off the current supply to the primary winding of an ignition coil, and the secondary winding voltage developed across the secondary winding of the ignition coil upon cutting-off of the primary current supply is required to have a high enough energy to generate a spark between the electrodes of a spark plug which is connected to the secondary winding of the ignition coil. In addition, it is necessary to limit the secondary winding voltage thus generated to a suitable energy level which does not cause dielectric breakdown of electronic or electric components of the ignition apparatus, the breakdown voltages for the components being determined in accordance with rated resistant voltages predetermined for the components. To this end, a maximum value of the primary winding current has to be limited to a prescribed value. However, the magnitude of voltage, which is supplied from a DC power supply such as a storage battery to the ignition coil for proper ignition, varies depending upon the operating condition of the engine, so it is general practice for the ignition apparatus to be equipped with a current limiter for limiting the primary winding current to an appropriate level in accordance with the operating condition of the engine.

Current limiters as conventionally used are operated by the base-emitter voltage of a power transistor which drives an ignition coil for turning on and off the current supply to the primary winding thereof.

FIG. 3 illustrates the circuit arrangement of a typical example of such a type of current limiter generally used in an ignition apparatus for an internal combustion engine. In this figure, a DC power source 1 in the form of a storage battery, which generates a source voltage $V_B$, is connected to an ignition coil 2 which has a primary winding 2a and a secondary winding 2b of which the latter is connected to one of electrodes of a spark plug 3, whose the other electrode is connected to ground. A power transistor 4 comprising a pair of transistors coupled to form a Darlington circuit has a common collector connected to the primary winding 2a of the ignition coil 2, and a base connected to a node between a resistor 5, which is connected to a node between the storage battery 1 and the primary winding 2a, and a collector of a drive transistor 6 which has an emitter connected to ground. The drive transistor 6 is incorporated in an ECU (not shown). A current limiter, generally designated by reference numeral 10, is connected between the emitter and the collector of the power transistor 4. The current limiter 10 includes a current sensing resistor 11 connected between the emitter of the power transistor 4 and ground for sensing a primary voltage $V_D$ corresponding to a primary current $I_1$ flowing through the power transistor 4, a reference voltage source 12 for generating a reference voltage $V_R$ for comparison with the primary voltage $V_D$ as sensed by the current sensing resistor 11, and a differential amplifier 20 for absorbing a sink current Is from a base current $I_{B4}$ supplied to the base of the power transistor 4 in proportion to a deviation or difference of the sensed primary voltage $V_D$ from the reference voltage $V_R$. The differential amplifier 20 has a first or non-inverted input terminal connected to the reference voltage source 12 so as to be supplied with the reference voltage $V_R$, a second or inverted input terminal connected to a node between the emitter of the power transistor 4 and the resistor 11 so as to be imposed upon by the primary voltage $V_D$ across the resistor 11, and an output terminal S connected to a node between the base of the power transistor 4 and the junction between the resistor 5 and the collector of the drive transistor 6. The differential amplifier 20 is driven by the sum of an emitter-base voltage of the power transistor 4 and the voltage across the current sensing resistor 11 so as to absorb a part of the base current $I_{B4}$ flowing from the storage battery 1 to the base of the power transistor 4 through the resistor 5 as a sink current Is.

FIG. 4 is a circuit diagram showing a more concrete structure of the differential amplifier 20 of FIG. 3. In this figure, the reference voltage source 12 of FIG. 3 comprises a constant current source 12a connected to the storage battery 1 through the resistor 5 for generating a constant current, and an NPN transistor 12b connected between the constant current source 12a and ground. The transistor 12b has a collector connected to the constant current source 12a, a base directly coupled to the collector thereof to form a diode connection, and an emitter grounded. A junction between the constant current source 12a and the collector of the transistor 12b is connected to the first or non-inverted input terminal of the differential amplifier 20 for applying thereto a reference voltage $V_R$ across the transistor 12b.

The differential amplifier 20 includes an NPN transistor 21 which has a base coupled to the junction between the constant current source 12a and the collector of the transistor 12b, the base acting as the first or reference input terminal of the differential amplifier 20, an NPN transistor 22 which has a base connected to a junction between the collector of the power transistor 4 and the resistor 11, the base acting as a second or sensing input terminal of the differential amplifier 20, a PNP transistor 23 having a collector coupled to the collector of the transistor 21, a PNP transistor 24 having a collector coupled to the collector of the transistor 22, an NPN transistor 25 which has a collector coupled to the base of the power transistor 4, the collector acting as the output terminal of the differential amplifier 20, a base coupled to a junction between the collectors of the transistors 21, 23, and an emitter grounded, and a resistor 26 having one end connected to a junction A between the bases of the transistors 21, 22 and the other end connected to ground. The transistors 23, 24 have their emitters coupled together to the base of the power transistor 4 and their bases coupled to each other to form a current mirror circuit. The base and the collector of the transistor 24 are directly connected to each other to form a short circuit.

The operation of the above-mentioned current limiter of FIG. 4 will now be described in detail while referring to FIG. 3. When the drive transistor 6 in the unillustrated ECU is turned off to start the power supply to the ignition coil 2, the source voltage $V_B$ of the storage battery 1 is imposed on the base of the power transistor 4 through the resistor 5, thus turning the transistor 4 on. As a result, a primary current $I_1$ begins to flow from the primary winding 2a of the ignition coil 2 to the emitter of the power transistor 4 via the collector thereof. A part of the primary current $I_1$ branches into the current sensing resistor 11 of a limited resistance so that there develops a voltage drop $V_D$ across the resistor 11.

At the same time, the current limiter 10 starts to control the base current $I_{B4}$ to the power transistor 4 so that the sensed voltage $V_D$ across the resistor 11 corresponding to the primary current $I_1$ is made equal to the reference voltage $V_R$ across the collector-emitter of the transistor 12b, as imposed on the base of the transistor 21. That is, when the sensed voltage $V_D$ becomes equal to the reference voltage $V_R$, a part of base current $I_{B4}$, which is to be supplied to the base of the power transistor 11, is absorbed as a so-called sink current Is by the differential amplifier 20, which forms a negative feedback loop, thus reducing the magnitude of the base current $I_{B4}$. As a result, the primary current $I_1$ is controlled or limited to a level corresponding to the predetermined reference voltage $V_R$. In this connection, as shown in FIG. 4, a constant current is supplied from the constant current source 12a to the transistor 12b of the reference voltage source 12, so the reference voltage $V_R$ imposed on the base of the transistor 21 is held at a constant level. The reference voltage $V_R$ is set in advance to a value equal to the sensed voltage $V_D$ across the resistor 11 generated at the time when the primary current $I_1$ flowing in the primary winding 2a of the ignition coil 2 reaches a predetermined limit value.

If the sensed voltage $V_D$ exceeds the reference voltage $V_R$, the base voltage of the transistor 22 at the current-sensing input terminal of the differential amplifier 20 rises while the base voltage of the transistor 21 at the reference input terminal of the differential amplifier 20 remains constant. Consequently, the transistor 22 is being turned on, so the voltage at the junction A between the bases of the transistors 21, 22 is accordingly increasing, causing the transistor 21 in a direction to be turned off.

On the other hand, the transistors 23, 24, which together constitute a current mirror circuit, function to flow currents of the same magnitude, so that as the transistor 21 is being turned off, the current flowing from the transistor 23 into the output transistor 25 is increasing. As a result, the output transistor 25 absorbs a sink current Is from the base current $I_{B4}$ to be supplied to the base of the power transistor 4 in proportion to the magnitude of the sensed voltage $V_D$, whereby the primary current $I_1$ is accordingly decreased to a predetermined value corresponding to the reference voltage $V_R$.

In this regard, the current limiter 10 is required to operate such that the differential amplifier 20 functions to control the base current $I_{B4}$ of the power transistor 4 on the basis of the sum of the voltage across the base-emitter of the power transistor 4 and the voltage across the current sensing resistor 11. However, the magnitude of the base current $I_{B4}$ is so great that if the capacity of the differential amplifier 20 is insufficient, the level of the sensed primary voltage $V_D$ will be offset from the actual level thereof, thus making it difficult for the current limiter 10 to exhibit an expected predetermined current limiting characteristic. That is, even if the sensed voltage $V_D$ exceeds a dynamic input range of the differential amplifier 20 and maximizes the base current to the output transistor 25, the output transistor 25 becomes unable to absorb the base current $I_{B4}$ supplied to the base of the power transistor 4 to a satisfactory or sufficient extent. Specifically, if there is an offset in the level of the voltage $V_D$ across the resistor 11 as sensed by the differential amplifier 20, the operating characteristic of the current limiter 10 exhibits voltage dependency. In other words, the operating characteristic varies depending upon the voltage as sensed, so the current limiting value, to which the current limiter 10 limits the primary current $I_1$, increases such that a large secondary current in excess of a predetermined allowable limit can be developed when the power transistor 4 is turned off.

With the above-described known current limiter for an internal combustion engine in which the sink current Is is absorbed by the single output transistor 25 alone, however, it is difficult to reduce the base current $I_{B4}$ to the power transistor 4 to a satisfactory extent, resulting in the problem that an excessive increase in the ignition current flowing in the ignition coil 2 cannot be suppressed.

In order to cope with this situation, it is considered to increase the amplification factor or gain of the output transistor 25, but such a measure is subject to certain limitations and drawbacks. Namely, it is generally known that if the amplification factor is increased above a certain value (i.e., greater than "1") and if there is a phase shift in a feedback signal greater than 180 degrees, the current limiter generally causes oscillations. To prevent this, costly measures must be taken, resulting in a complicated arrangement and an increased manufacturing cost.

SUMMARY OF THE INVENTION

Accordingly, the present invention is intended to overcome the above-mentioned problems encountered with the known current limiter.

An object of the invention is to provide a novel and improved current limiter in an ignition apparatus for an internal combustion engine which is able to limit a primary winding current of an ignition coil to a prescribed limit value which is independent of a voltage as sensed by a current sensing resistor, thus providing a highly stable operating characteristic.

Another object of the invention is provide a novel and improved current limiter in an ignition apparatus for an internal combustion engine in which the amplification factor of a differential amplifier can be increased without accompanying oscillations of the current limiter, and which is still simple in construction and inexpensive to manufacture.

According to one aspect of the invention, there is provided a current limiter in an ignition apparatus including a battery, an ignition coil connected to the battery, and a drive transistor connected to a junction between the battery and the ignition coil, the ignition coil having a primary winding connected to a power transistor and a secondary winding connected to a spark plug. The current limiter comprises: a current sensing resistor for sensing a voltage corresponding to a current flowing from the primary winding of the ignition coil to the power transistor; a reference voltage source for generating a reference voltage for comparison with the voltage sensed by the current sensing resistor; a differential amplifier for absorbing a part of a base current to be supplied from the battery to a base of the power transistor on the basis of a difference between the reference voltage and the voltage sensed by the current sensing resistor; and a plurality of output transistors coupled to form a Darlington circuit which is connected between the differential amplifier and the base of the power transistor.

Preferably, the output transistors comprise: a first transistor having a collector connected to the base of the power transistor, a base connected to the differential amplifier and an emitter connected to ground through a resistor; and a second transistor having a collector coupled to the collector of the first transistor, a base coupled to the emitter of the first transistor, and an emitter connected to ground.

According to another aspect of the invention, the current limiter comprises: a current sensing resistor for sensing a voltage corresponding to a current flowing from the primary winding of the ignition coil to the power transistor; a differential amplifier having a first input terminal and a second input terminal and absorbing a part of a base current to be supplied from the battery to a base of the power transistor on the basis of a difference between a reference voltage imposed on the first input terminal thereof and a voltage imposed on the second input terminal thereof; a first reference voltage source connected to the first input terminal of the differential amplifier for supplying thereto a first reference voltage; a second reference voltage source for generating a second reference voltage, the second reference voltage source being connected between the current sensing resistor and the second input terminal of the differential amplifier for supplying thereto a total sum of the voltage sensed by the current sensing resistor and the second reference voltage; and a plurality of output transistors coupled to form a Darlington circuit which is connected between the differential amplifier and the base of the power transistor.

Preferably, the first reference voltage source comprises: a first constant current source for generating a first constant current; and a first transistor connected between the first constant current source and ground in a diode-like manner, a junction between the first constant current source and the first transistor being connected to the first input terminal of the differential amplifier.

The first reference voltage source may further comprise a temperature compensator for temperature compensating the first reference voltage imposed on the first input terminal of the differential amplifier.

Preferably, the temperature compensator comprises: a second transistor having a collector connected to the first constant current source, a base coupled to the collector thereof and to the first input terminal of the differential amplifier through a resistor, and an emitter coupled to the first transistor; and a resistor connected between the first input terminal of the differential amplifier and the first transistor.

Preferably, the second reference voltage source comprises: a second constant current source for generating a second constant current of a magnitude less than the first constant current generated by the first constant current source; and a third transistor connected between the second constant current source and a junction between the emitter of the power transistor and the current sensing resistor in a diode-like manner.

The above and other objects, features and advantages of the invention will become readily apparent from the following detailed description of a few preferred embodiment of the invention taken in conjunction with the accompanying drawings.

BRIEF DESCRIPTION OF THE DRAWINGS

In the drawings, the same or corresponding parts are identified by the same symbols.

DESCRIPTION OF THE PREFERRED EMBODIMENTS

A few embodiments of the present invention will now be described in detail with reference to the accompanying drawings.

Figure 1:
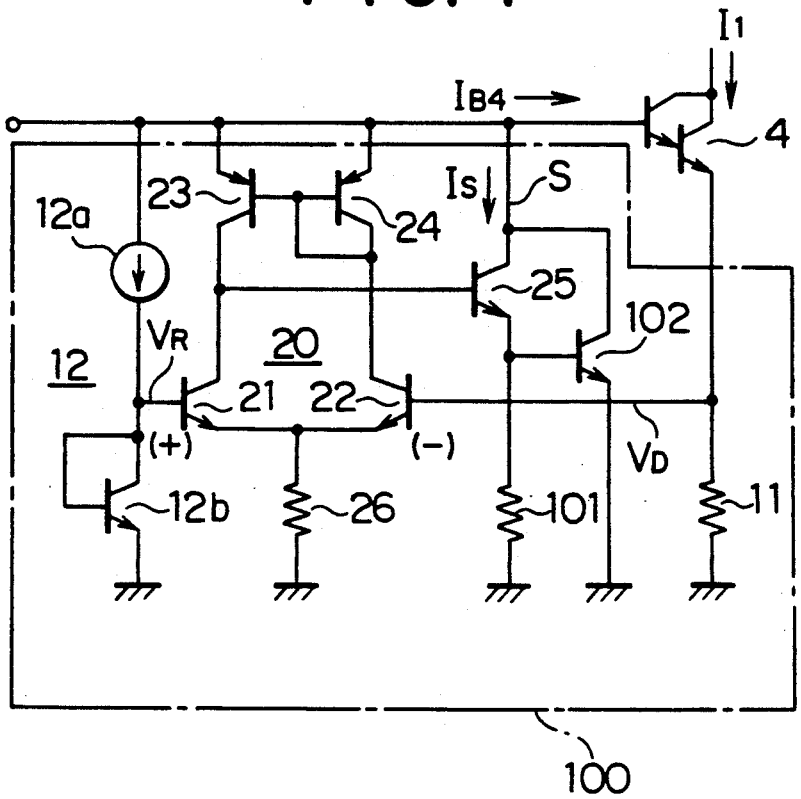
FIG. 1 is a circuit diagram of a current limiter in an ignition apparatus for an internal combustion engine in accordance with a first embodiment of the invention.
Figure 4:
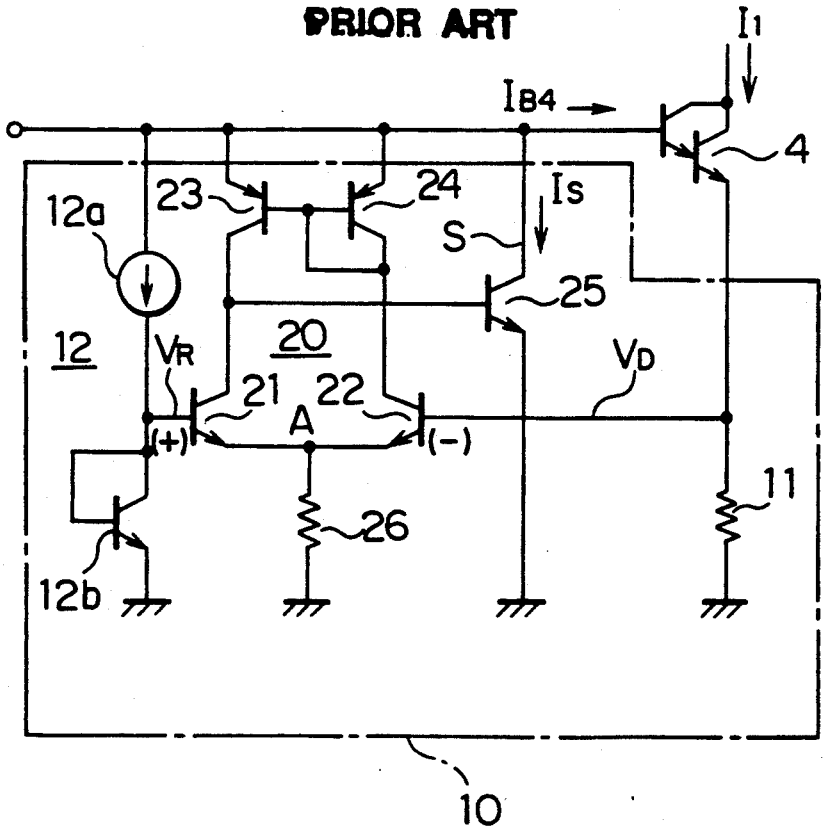
FIG. 4 PRIOR ART
FIG. 4 is a circuit diagram of the known current limiter of FIG. 3.

Referring first to FIG. 1, there is shown a current limiter 100 in an ignition apparatus for an internal combustion engine in accordance with a first embodiment of the invention. The current limiter 100 illustrated is substantially similar to the aforementioned known current limiter of FIG. 4, and hence it includes a reference voltage source 12 comprising a constant current source **12*a* and a transistor 12*b*, a differential amplifier 20 comprising transistors 21 through 25 and a resistor 26, and a current sensing resistor 11, all of which are the same as those of the known current limiter 10 of FIG. 4. In addition to these elements, the current limiter 100 of this embodiment includes a resistor 101 connected between an emitter of the transistor 25 and ground, and a transistor 102 coupled to the transistor 25 in an emitter follower manner to form a Darlington circuit. The transistor 102 has a collector coupled to the collector of the transistor 25, a base coupled to the emitter of the transistor 25**, and an emitter connected to ground.

Figure 3:
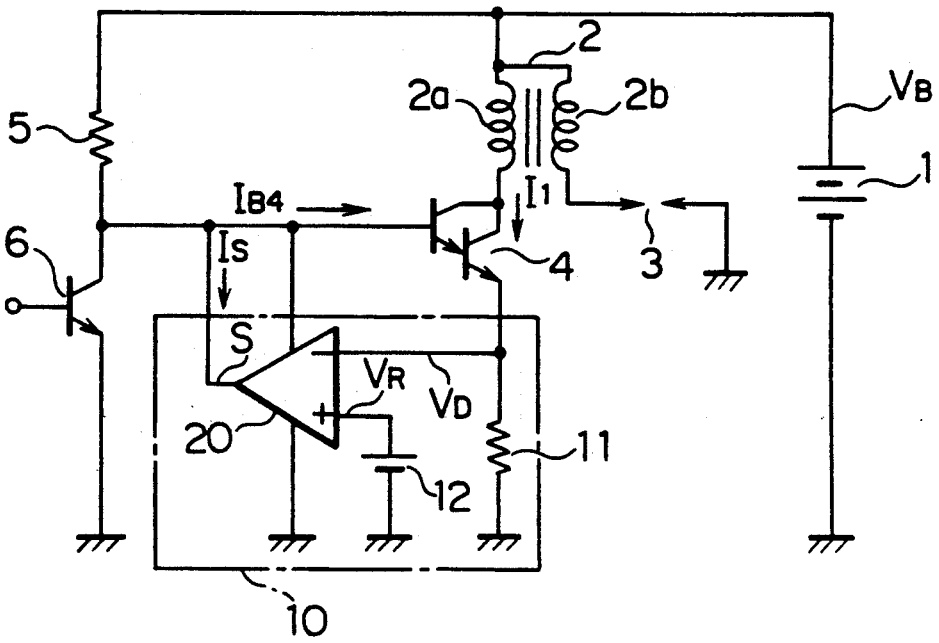
FIG. 3 PRIOR ART
FIG. 3 is a circuit diagram of a known ignition apparatus with a known current limiter for an internal combustion engine.

The operation of this embodiment will be described in detail below while referring to FIGS. 1 and 3 with an assumption that the current limiter 100 of this embodiment is incorporated in the known ignition apparatus of FIG. 3. When a primary current $I_1$ flowing in the primary winding **2*a* of the ignition coil 2 exceeds a limit value to increase a base current supplied to the base of the output transistor 25 to its activation level, the output transistor 25 is turned on so that another output transistor 102, which is coupled to the transistor 25 to form a Darlington pair, also becomes on. As a result, a sink current Is, which is a part of the base current $I_{B4}$ to the power transistor 4 to be absorbed, becomes the sum of the current through the transistor 25 and the current through the transistor 102**.

In this case, the base current of the output transistor 25 serves to control the base current $I_{B4}$ of the power transistor 4 on the basis of a total gain of current magnification which is given by the current magnification factor of the transistor 25 multiplied by that of the transistor 102. That is, the magnitude of the sink current Is depends on the total current magnification gain of a large value given by the product of the individual current magnification gains or factors of the transistors 25, 102, and hence it becomes great, so even a large base current $I_{B4}$ can be controlled in a satisfactory manner.

On the other hand, if the output transistors 25, 102 are coupled to form a Darlington circuit in the above manner, there is a fear that the lower limit value for activating the differential amplifier 20 can exceed the base voltage of the power transistor 4. Thus, if the source voltage $V_B$ of the storage battery 1, which supplies the base current $I_{B4}$ to the base of the power transistor 4, increases, the drive or activation voltage for driving the differential amplifier 20, which controls the base current $I_{B4}$ supplied to the base of the power transistor 4, is suppressed by the base voltage of the power transistor 4. As a result, the limit value for limiting the magnitude of the primary current $I_1$ is affected by or made dependent on the base voltage of the power transistor 4. In other words, the current limiting value has a voltage-dependent characteristic.

More specifically, when the base current $I_{B4}$ increases in accordance with the increasing source voltage $V_B$, it becomes difficult to maintain or limit the primary winding current $I_1$ to a predetermined value unless an additional or extra current in excess of the original or normal source voltage is absorbed.

On the other hand,the base voltage of the output transistor 25 is determined by the emitter currents of the output transistors 25, 102. Accordingly, in order to ensure the lower limit activation voltage for the differential amplifier 20, it is required that the sum of the base voltage of the transistor 25 and the collector-emitter voltage of the transistor 23 at the time when the sink current Is becomes the greatest within the range of variation of the source voltage $V_B$ is less than the base voltage of the power transistor 4.

That is, if the sum of the base-emitter voltages of the output transistors 25, 102 and the collector-emitter voltage of the transistor 23 is set to be less than the sum of the base-emitter voltage of the power transistor 4 and the voltage across the current sensing resistor 11, there is no offset in the differential amplifier 20, so the current limiting value exhibits no voltage dependency.

In general, the base-emitter voltage of a transistor is in proportion to the current density of emitter current thereof. Thus, as areas of emitter cells increase, the current density per unit area decreases, allowing a decrease in the lower limit activation voltage for the differential amplifier 20. Therefore, for the purpose of lowering the lower limit activation voltage of the differential amplifier 20, it is necessary that the emitter cells of the output transistors 25, 102 increase to proper sizes suitable to make the emitter voltages of the transistors 23, 24 lower than the base voltage of the power transistor 4. With this, the differential amplifier 20 can be operated without fail irrespective of variations or an increase in the source voltage $V_B$, and the voltage dependency of the current limiting characteristic of the current limiter 100 is suppressed in a reliable manner.

Although in the above embodiment, the reference voltage source 12 comprises the constant current source **12*a* and the transistor 12*b*, it may be a usual DC power source which can apply a constant voltage to the base of the transistor 21**.

Figure 2:
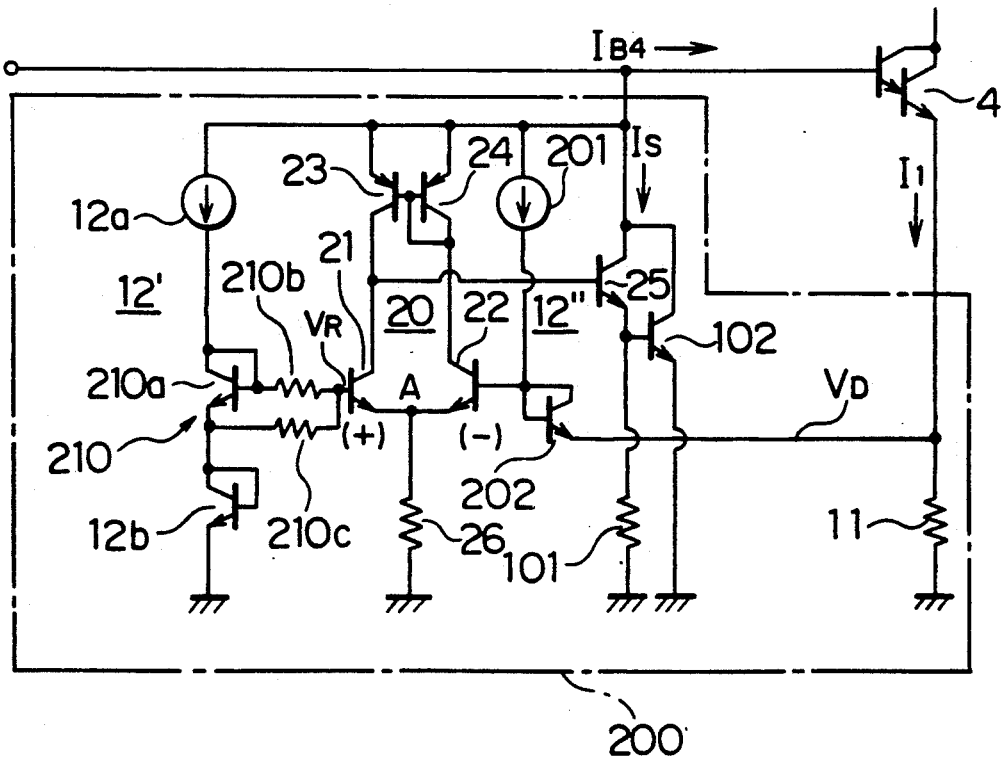
FIG. 2 is a view similar to FIG. 1, but showing another embodiment of the invention.

FIG. 2 shows a current limiter 200 in accordance with another embodiment of the present invention. The current limiter 200 of this embodiment is substantially similar to the first mentioned embodiment of FIG. 1 except for the following features.

A reference voltage source 12' includes a temperature compensator 210 in addition to a first constant current source **12*a* and a transistor 12*b*. The temperature compensator 210 comprises an NPN transistor 210*a* which has a collector connected to the first constant current source 12*a*, an emitter coupled to the collector of the transistor 12*b*, and a base coupled through a resistor 210*b* to the base of a transistor 21, and a resistor 210*c* connected at one end thereof to a node between the resistor 210*b* and the base of the transistor 21, and at the other end to a node between the emitter of the transistor 210*a* and the collector of the transistor 12*b*. The base and collector of the transistor 210*a* are directly coupled to each other to form a short circuit. The voltage across the emitter-collector of the transistor 12*a* is applied through the resistor 210*c* to the base of the transistor 21** as a first reference voltage $V_R$.

Another or second reference voltage source 12" is provided at the second input terminal of the differential amplifier 20. The second reference voltage source 12" comprises a second constant current source 201, which supplies a current less than the current supplied by first constant current source **12*a*, connected at one end thereof to the base of the power transistor 4 and at the other end thereof to the collector of a transistor 202 which has a base coupled to the base of transistor 22 at a junction between the second constant current source 201 and the collector of the transistor 202, and an emitter connected to a junction between the emitter of the power transistor 4 and the current sensing resistor 11. A second reference voltage across the emitter-collector of the transistor 202 is added to the voltage $V_D$ across the current sensing resistor 11, so that a total sum of these voltages is imposed on the base of the transistor 22 which acts as the second or inverted input terminal at the current sensing side of the differential amplifier 20**.

In operation, as described in the first embodiment of FIG. 1, when a primary current $I_1$ flowing in the primary winding of the ignition coil exceeds a limit value to increase a base current supplied to the base of the output transistor 25 to its activation level, the output transistor 25 is turned on so that another output transistor 102, which is coupled to the transistor 25 to form a Darlington pair, also becomes on. As a result, a sink current Is, which is a part of the base current $I_{B4}$ of the power transistor 4 to be absorbed, becomes the sum of the current through the transistor 25 and the current through the transistor 102. Thus, the magnitude of the sink current Is depends on the total gain of current magnification given by the product of the individual current magnification gain of the transistors 25, 102, and hence it becomes large, so a large base current $I_{B4}$ can be controlled in a satisfactory manner, as in the first mentioned embodiment of FIG. 1.

In this regard, since the magnitude of current $I_{12}$ (called "a first current") supplied by the first constant current sources **12*a* is greater than that $I_{201}$ (called "a second current") of the second constant current source 201 ($I_{12} > I_{201}$), the base-emitter voltage of the transistor 12*b* (i.e., the first reference voltage $V_R$), through which the current $I_{12}$ from the first constant current source 12*a* flows, is greater than that of the transistor 202 (i.e., the second reference voltage $V_R'$), through which the current $I_{201}$ from the second constant current source 201** flows. The difference ($V_R - V_R'$) between the first and second reference voltages $V_R$, $V_R'$ is proportional to the ratio of the first current $I_{12}$ to the second current $I_{201}$, and it is expressed as follows:

$$V_R - V_R' = K \times I_{12}/I_{201}$$

The first reference voltage $V_R$ is imposed on the non-inverted or reference input terminal of the differential amplifier 20 whereas the second reference voltage $V_R'$ is added to the sensed voltage $V_D$ across the current sensing resistor 11 so that the sum of these voltages $V_R'$, $V_D$ is imposed on the inverted or current-sensing input terminal of the differential amplifier 20. As a result, the differential amplifier 20 functions to satisfy the following equation:

$$V_R = V_R' + V_D$$

On this occasion, since the respective reference voltages $V_R$, $V_R'$ are set to sufficiently large values by the transistors 12b, 202, respectively, there is no need to provide any signal amplifier to the differential amplifier 20.

In addition, the loop gain of the current limiter 200 can be set to a value less than "1", so that even if there is a variation in the load condition at the collector of the power transistor 4, oscillations of the current limiter 200 can be avoided without employing any phase adjusting means.

Further, the ratio of the first current $I_{12}$ of the first constant current source 12a and the second current $I_{201}$ of the second current source 201 can be properly set in accordance with various conditions such as, for example, a desired limit value for the primary current $I_1$, a desired resistance of the current sensing resistor 11, etc.

What is claimed is:

1. A current limiter in an ignition apparatus including a battery, an ignition coil connected to said battery, and a drive transistor connected to a junction between said battery and said ignition coil, said ignition coil having a primary winding connected to a power transistor and a secondary winding connected to a spark plug, said current limiter comprising:

a current sensing resistor for sensing a voltage corresponding to a current flowing from the primary winding of said ignition coil to said power transistor;

a differential amplifier having a first input terminal and a second input terminal and absorbing a part of a base current to be supplied from said battery to a base of said power transistor on the basis of a difference between a reference voltage imposed on the first input terminal thereof and a voltage imposed on the second input terminal thereof;

a first reference voltage source connected to the first input terminal of said differential amplifier for supplying thereto a first reference voltage;

a second reference voltage source for generating a second reference voltage, said second reference voltage source being connected between said current sensing resistor and the second input terminal of said differential amplifier for supplying thereto a total sum of the voltage sensed by said current sensing resistor and the second reference voltage; and a plurality of output transistors coupled to form a Darlington circuit which is connected between said differential amplifier and the base of said power transistor.

2. A current limiter according to claim 1, wherein said first reference voltage source comprises:

a first constant current source for generating a first constant current; and a first transistor connected between said first constant current source and ground in a diode-like manner, a junction between said first constant current source and said first transistor being connected to the first input terminal of said differential amplifier.

3. A current limiter according to claim 2, wherein said first reference voltage source further comprises a temperature compensator for temperature compensating the first reference voltage imposed on the first input terminal of said differential amplifier.

4. A current limiter according to claim 3, wherein said temperature compensator comprises:

a second transistor having a collector connected to said first constant current source, a base coupled to the collector thereof and to the first input terminal of said differential amplifier through a resistor, and an emitter coupled to said first transistor; and a resistor connected between the first input terminal of said differential amplifier and said first transistor.

5. A current limiter according to claim 2, wherein said second reference voltage source comprises:

a second constant current source for generating a second constant current of a magnitude less than the first constant current generated by said first constant current source; and a third transistor connected between said second constant current source and a junction between the emitter of said power transistor and said current sensing resistor in a diode-like manner.

6. A current limiter according to claim 5, wherein said third transistor has a collector connected to said second constant current source and to the second input terminal of said differential amplifier, an emitter connected to said junction, and a base connected to the collector thereof.

* * * * *